US009958176B2

(12) United States Patent
Bicknell

(10) Patent No.: US 9,958,176 B2
(45) Date of Patent: May 1, 2018

(54) HVAC SYSTEM WITH CAMERA AND MICROPHONE

(71) Applicant: Trane International Inc., Piscataway, NJ (US)

(72) Inventor: Kirby Neal Bicknell, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 583 days.

(21) Appl. No.: 14/167,887

(22) Filed: Jan. 29, 2014

(65) Prior Publication Data

US 2014/0217185 A1 Aug. 7, 2014

Related U.S. Application Data

(60) Provisional application No. 61/762,203, filed on Feb. 7, 2013.

(51) Int. Cl.
*F24F 11/00* (2018.01)

(52) U.S. Cl.
CPC ... *F24F 11/0034* (2013.01); *F24F 2011/0053* (2013.01); *F24F 2011/0091* (2013.01)

(58) Field of Classification Search
CPC ..... F24F 11/0034; F24F 2011/0053; F24F 2011/0091; G10L 15/265; G10L 15/22; G10L 15/30; G06F 3/16
USPC ..... 704/275; 382/103, 115
See application file for complete search history.

(56) References Cited

U.S. PATENT DOCUMENTS

| | | | | |
|---|---|---|---|---|
| 6,420,975 | B1 * | 7/2002 | DeLine | B60R 1/12 340/425.5 |
| 6,866,089 | B2 | 3/2005 | Avila | |
| 7,369,156 | B1 | 5/2008 | Heinke et al. | |
| 7,415,126 | B2 | 8/2008 | Breed et al. | |
| 7,529,646 | B2 | 5/2009 | Lin et al. | |
| 7,811,159 | B2 | 10/2010 | Wilson et al. | |
| 7,856,643 | B2 | 12/2010 | Machinist et al. | |
| 8,144,836 | B2 | 3/2012 | Naidoo et al. | |
| 8,174,378 | B2 | 5/2012 | Richman et al. | |
| 8,200,778 | B2 | 6/2012 | Edwards et al. | |
| 8,321,885 | B2 | 11/2012 | Pino, Jr. et al. | |

(Continued)

OTHER PUBLICATIONS

Coldewey, Devin; "$50,000, Six-foot Air Conditioner Obeys Voice Commands"; NBC News Digital; 2013; 1 page.

(Continued)

*Primary Examiner* — Kun Kai Ma
(74) *Attorney, Agent, or Firm* — Conley Rose, P.C.; J. Robert Brown, Jr.

(57) ABSTRACT

A heating, ventilation, and air conditioning (HVAC) system has an input configured to receive at least one of a first heating setting, a first ventilation setting, a first cooling setting, a first humidity setting, and a first air quality setting, at least one of an image sensor and a microphone connected to at least one component in the HVAC system, the image sensor and/or microphone being configured to capture data from a first zone, and a controller connected to the input and at least one of the image sensor and the microphone, the controller configured to control at least one of the first heating setting, the first ventilation setting, the first cooling setting, the first humidity setting, and the first air quality setting in response to receiving the data from at least one of the image sensor and the microphone.

20 Claims, 3 Drawing Sheets

(56) References Cited

U.S. PATENT DOCUMENTS

| | | | | |
|---|---|---|---|---|
| 8,334,906 | B2 * | 12/2012 | Lipton | G08B 13/1961 348/143 |
| 8,356,342 | B2 | 1/2013 | Parkinson et al. | |
| 8,358,342 | B2 | 1/2013 | Park | |
| 9,489,564 | B2 * | 11/2016 | Gattuso | H04N 5/23219 |
| 2002/0114002 | A1 * | 8/2002 | Mitsubori | H04N 1/00326 358/1.15 |
| 2004/0267385 | A1 * | 12/2004 | Lingemann | G05B 15/02 700/83 |
| 2006/0208099 | A1 * | 9/2006 | Chapman, Jr. | F24F 11/0034 236/51 |
| 2007/0012793 | A1 * | 1/2007 | Flood | F23N 5/20 236/51 |
| 2007/0045431 | A1 * | 3/2007 | Chapman, Jr. | F24F 11/0012 236/46 C |
| 2008/0059175 | A1 * | 3/2008 | Miyajima | G10L 15/25 704/246 |
| 2009/0326936 | A1 * | 12/2009 | Nagashima | 704/235 |
| 2010/0070089 | A1 * | 3/2010 | Harrod | F24F 11/0086 700/277 |
| 2010/0168923 | A1 * | 7/2010 | Park | F24F 11/0034 700/278 |
| 2011/0069155 | A1 * | 3/2011 | Cho | G06K 9/00335 348/47 |
| 2011/0264296 | A1 * | 10/2011 | Drake | G01D 4/004 700/296 |
| 2012/0128025 | A1 * | 5/2012 | Huppi | G01K 1/16 374/121 |
| 2012/0169465 | A1 * | 7/2012 | Chang | B60W 50/00 340/5.83 |
| 2013/0138250 | A1 * | 5/2013 | Mowery | G05D 23/1917 700/276 |
| 2013/0182905 | A1 * | 7/2013 | Myers | H04N 7/18 382/103 |
| 2014/0211985 | A1 * | 7/2014 | Polese | G06K 9/00362 382/103 |
| 2016/0283793 | A1 * | 9/2016 | Leckey | G06K 9/00221 |

OTHER PUBLICATIONS

LG Whisen; "Air Conditioning Releases the World's First Direct Voice Recognition"; LG Newsroom; http://www.lgnewsroom.co.kr/contents/23347; Jan. 2, 2013; 2 pages.

* cited by examiner

HVAC SYSTEM WITH CAMERA AND MICROPHONE

CROSS-REFERENCE TO RELATED APPLICATIONS

The present application claims priority under 35 U.S.C. 119(*e*) to U.S. Provisional Patent Application No. 61/762,203 filed on Feb. 7, 2013 by Bicknell and entitled "HVAC System with Camera and Microphone," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems with programmable system controllers may be used to control the indoor temperature of buildings. The programmable systems may adjust a user selected temperature based on a schedule. HVAC systems may consume a large amount of energy relative to other building systems, and changes in weather may affect the amount of energy consumed. HVAC systems may be controlled by settings for heating, ventilation, cooling, humidity, and/or air quality. Typically, a user enters the settings at a thermostat or other user interface via a keypad, touchscreen, or the like. Sensors for providing inputs for controlling the HVAC system may comprise a temperature sensor, a humidity sensor, an air quality sensor, and/or a timer. For example, when a temperature sensor measures a temperature which falls below a setting in a particular zone, an HVAC system controller may activate a heating unit. Furthermore, for example, when a humidity sensor measures a relative humidity which falls below a setting in a particular zone, an HVAC system controller may activate a humidifier.

SUMMARY

In some embodiments of the disclosure, a heating, ventilation, and air conditioning (HVAC) system is disclosed as comprising an input device configured to receive at least one of a ventilation setting, a temperature setting, a humidity setting, and an air quality setting; an image sensor connected to at least one component of the HVAC system, wherein the image sensor is configured to capture image data from a first zone; and a controller connected to the input device and the image sensor, wherein the controller is configured to control at least one of the ventilation setting, the temperature setting, the humidity setting, and the air quality setting in response to receiving the image data.

In other embodiments of the disclosure, a heating, ventilation, and air conditioning (HVAC) system, comprising an input device configured to receive at least one of a ventilation setting, a temperature setting, a humidity setting, and an air quality setting; a microphone connected to at least one component of the HVAC system, wherein the microphone is configured to capture an audio signal from a first zone; and a controller connected to the input and connected to the microphone, wherein the controller is configured to control at least one of the ventilation setting, the temperature setting, the humidity setting, and the air quality setting in response to receiving the audio data.

In yet other embodiments of the disclosure, a method for controlling a heating, ventilation, and air conditioning (HVAC) system is disclosed as comprising: entering a first setting into an HVAC system controller, wherein the first setting is at least one of a first temperature setting, a first ventilation setting, a first humidity setting, and a first air quality setting; capturing at least one of (1) image data from an image sensor in a first zone and (2) audio data from a microphone in a first zone, wherein the first zone is at least partially controlled by the HVAC system; receiving at least one of the image data and the audio data into the HVAC system controller; recognizing a condition in the first zone as a result of receiving at least one of the image data and the audio data into the HVAC system controller; and changing the first setting to a second setting in the HVAC system controller as a result of recognizing the condition in the first zone, wherein the second setting is at least one of a second temperature setting, a second humidity setting, a second ventilation setting, and a second air quality setting.

DETAILED DESCRIPTION

Figure 1:
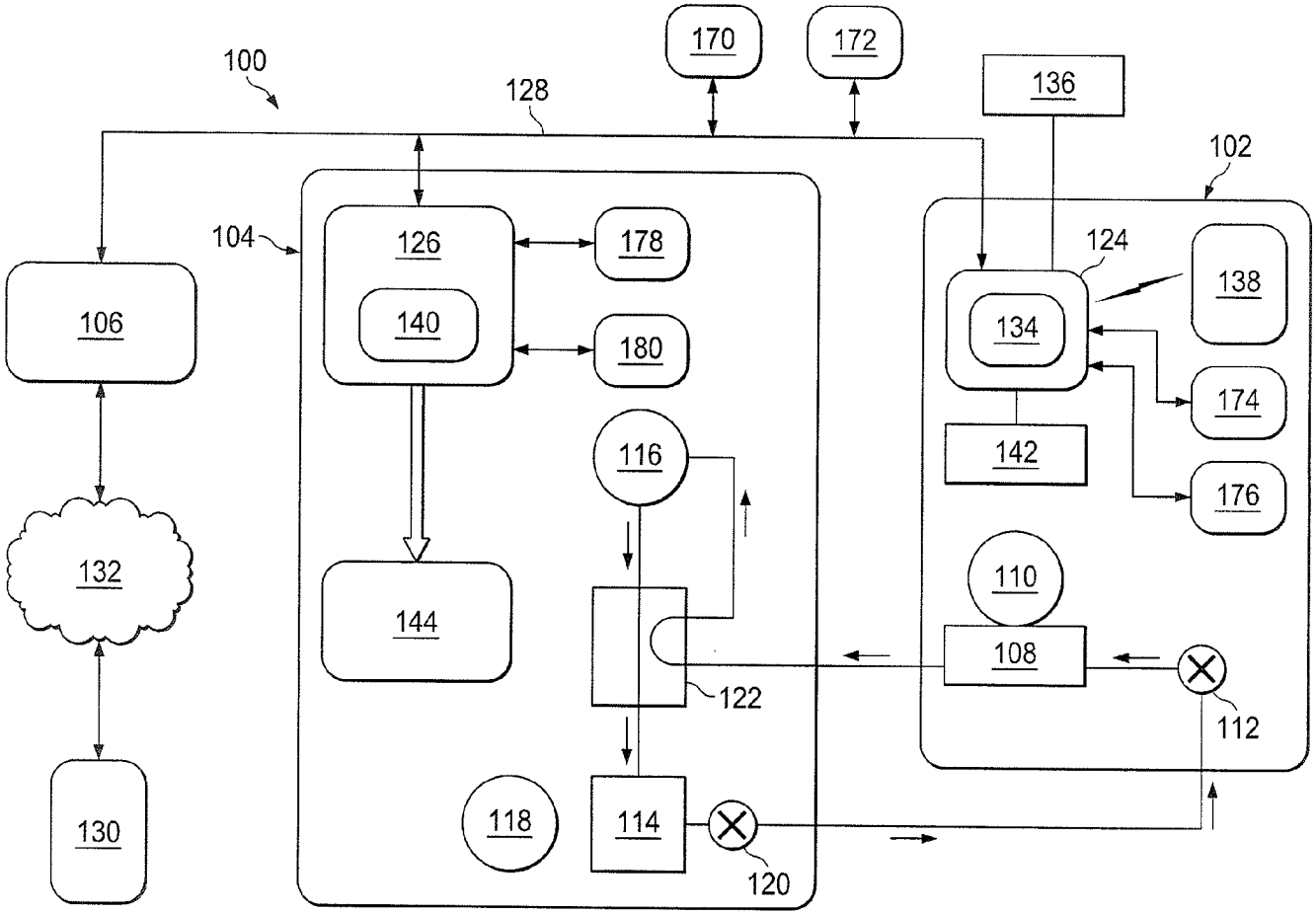
FIG. 1 is a schematic diagram of an HVAC system according to an embodiment of the disclosure.

An HVAC system according to embodiments of the disclosure may control indoor climate using not only measurements from timers and temperature, humidity, and air quality sensors, but also from image sensors and microphones. An image data set captured by the image sensor or an audio file captured by the microphone may be searched for the presence of predetermined conditions to reconfigure user settings. For example, if User A likes the room kept at 65 degrees in the winter, while User B likes the room kept at 72 degrees in the winter, an HVAC controller may recognize the presence of either User A or User B to change the default settings to the preferences of that particular user. In addition, the HVAC system controller may be programmed to prioritize one user over another user.

In another example, an HVAC system may be configured to cool a house when the temperature rises above 72 degrees. However, if an image sensor attached to an outdoor unit captures an image of User C or User D in the back yard, the HVAC system may override the default settings and suppress the cooling operation until User C and/or User D leave the back yard. This may be done to suppress the noise generation by the outdoor unit, or for various safety considerations. If User C is a small child, the operation of the outdoor unit with a high speed fan may present a safety consideration. If User D is typically present to mow the yard, presence of this individual may be a condition to trigger shut down of the outdoor unit to avoid grass being sucked into the outdoor unit, and clogging the heat exchanger.

The HVAC control system in some embodiments may be augmented by a microphone. The HVAC system controller may, for example, analyze audio data to recognize the particular sound of a mower used to mow grass in the zone around the outdoor unit to assist the HVAC system controller in determining whether to suppress the operation of the outdoor unit. This data may be used to augment the decisions made by the controller based on the image data. Numerous conditions may be recognized by audio data. In another example, the determination of the presence of a particular user may be augmented when the particular user's voice is recognized in audio data.

The HVAC system controller may further be configured to recognize movements in a particular zone to determine whether to reconfigure the HVAC system settings. Examples of movements may be a particular person entering or exiting the zone, a pet sleeping, a person watching TV, a hand or body gesture, a person exercising, or any other activity that a user may wish to use to reconfigure settings in an HVAC system. One or more microphones can be used to recognize movements of a person from room to room, or within a room, by recognition of speech patterns, words, or any other suitable sound property, for example. An image sensor attached to the HVAC system may be used to input an image data set which comprises a series of images captured at a regular interval, or in other words, a video or movie. Images later captured may be compared by the controller for recognition of the condition desired by the user. The user may further assign the reconfigured settings that are used by the HVAC system controller upon recognition of the predetermined condition.

Referring now to FIG. 1, a schematic diagram of an HVAC system 100 according to an embodiment of this disclosure is shown. HVAC system 100 comprises an indoor unit 102, an outdoor unit 104, and a system controller 106. In some embodiments, the system controller 106 may operate to control operation of the indoor unit 102 and/or the outdoor unit 104. As shown, the HVAC system 100 is a so-called heat pump system that may be selectively operated to implement one or more substantially closed thermodynamic refrigeration cycles to provide a cooling functionality and/or a heating functionality.

Indoor unit 102 comprises an indoor heat exchanger 108, an indoor fan 110, and an indoor metering device 112. Indoor heat exchanger 108 is a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger.

The indoor fan 110 is a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 is configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

Outdoor unit 104 comprises an outdoor heat exchanger 114, a compressor 116, an outdoor fan 118, an outdoor metering device 120, a reversing valve 122. Outdoor heat exchanger 114 is a spine fin heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a microchannel heat exchanger, or any other suitable type of heat exchanger.

In some embodiments, the HVAC system 100 may include provide cooling. In some embodiments, the HVAC system 100 may only provide heating. In some embodiments, the HVAC system 100 may only provide one of air circulation, ventilation, air purification, and humidification. So, for example, the reversing valve 122 may be left out for an HVAC system 100 with cooling only, or with an indoor furnace for heating. In some embodiments, the outdoor unit 104 and associated cooling functions may be entirely absent, and only an indoor furnace may be installed.

The compressor 116 is a multiple speed scroll type compressor configured to selectively pump refrigerant at a plurality of mass flow rates. In alternative embodiments, the compressor 116 may comprise a modulating compressor capable of operation over one or more speed ranges, the compressor 116 may comprise a reciprocating type compressor, the compressor 116 may be a single speed compressor, and/or the compressor 116 may comprise any other suitable refrigerant compressor and/or refrigerant pump.

The outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor metering device 120 is a thermostatic expansion valve. In alternative embodiments, the outdoor metering device 120 may comprise an electronically controlled motor driven EEV, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

The reversing valve 122 is a so-called four-way reversing valve. The reversing valve 122 may be selectively controlled to alter a flow path of refrigerant in the HVAC system 100 as described in greater detail below. The reversing valve 122 may comprise an electrical solenoid or other device configured to selectively move a component of the reversing valve 122 between operational positions. The system controller 106 may comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system 100.

In some embodiments, the system controller 106 may selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. In some embodiments, the system controller 106 may use communication bus 128 to communicate with a microphone 170 and an image sensor 172 attached to the communication bus 128. In some embodiments, the system controller 106 may use communication bus 128 to communicate with a microphone 174 and an image sensor 176 attached to indoor controller 124. In some embodiments, the system controller 106 may use communication bus 128 to communicate with a microphone 178 and an image sensor 180 attached to outdoor controller 126. Alternatively, the system controller 106 may connect directly with a microphone 170 and/or an image sensor 172.

Still further, the system controller 106 may be configured to selectively communicate with HVAC system 100 components and/or other devices 130 via a communication network 132. In some embodiments, the communication network 132 may comprise a telephone network and the other device 130 may comprise a telephone. In some embodiments, the communication network 132 may comprise the Internet and the other device 130 may comprise a computer, a so-called smartphone, and/or other Internet enabled mobile telecommunication device. In some embodiments, the communication network 132 may comprise a WiFi network such as IEEE 802.11b/g/n or other similar standard. The WiFi network may connect the system controller 106 to the Internet or another wireless telephone and data network. The WiFi network may also be used to connect microphone 170 and/or image sensor 172 to the network 132, to communication bus 128, and/or to system controller 106. In some embodiments, the system controller 106 may comprise a network port such as an Ethernet network port, or a wireless adapter for communication with the communication network 132 via the 802.11b/g/n standard, and/or any other suitable communication protocol.

The indoor controller 124 may be carried by the indoor unit 102 and may be configured to receive information inputs, transmit information outputs, and otherwise communicate with the system controller 106, the outdoor controller 126, and/or any other device via the communication bus 128 and/or any other suitable medium of communication. In some embodiments, the indoor controller 124 may be configured to communicate with an indoor personality module 134, receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

In some embodiments, the indoor controller 124, outdoor controller 126, or system controller 106 may comprise a display for displaying information such as a heating temperature setting, a cooling temperature setting, a humidity setting, a ventilation setting, and an air quality setting. The display may further be adapted for displaying image data sets from any of the image sensors 172, 176, and 180. In some embodiments, the indoor controller 124, outdoor controller 126, or system controller 106 may comprise a speaker for reproducing any of the information captured by microphones 170, 174, and 178. The speaker may further be configured to reproduce any sounds programmed into, input into, or generated by indoor controller 124.

In some embodiments, the indoor EEV controller 138 may be configured to receive information regarding temperatures and pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112.

The outdoor controller 126 may be carried by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor personality module 140 may comprise a display for displaying information such as a heating temperature setting, a cooling temperature setting, a humidity setting, a ventilation setting, and an air quality setting. The display may further be adapted for displaying image data sets from any of the image sensors 172, 176, and 180. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may be pumped from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to gaseous phase. The gaseous phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. The refrigerant may thereafter reenter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may reenter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Still further, the system controller 106 may be configured to selectively communicate with other systems via the communication network 132. In some embodiments, the system controller 106 may communicate with other devices 130, such as, telephones, smart phones, and/or personal computers.

System controller 106 may be configured to control indoor unit 102 and/or outdoor unit 104 based on input from image sensors 172, 176, and 180. A plurality of image sensors arranged to capture stereoscopic or extended views may be substituted for any of the image sensors 172, 176 and 180, which are depicted as single image sensors. Image sensor 176 may be attached to indoor unit 102 and connected to indoor controller 124. Image sensor 176 may be configured to collect image data from a zone adjacent to indoor unit 102.

The image sensors 172, 176, and 180 may generate one or more image data sets to send to system controller 106. The image data set may represent a still image, or a series of still images taken at different times or at different angles. In effect, the image data set may be a video sequence or movie. The size of the image data set may be adjusted to reasonably match the available bandwidth of communication bus 128. It may be adjusted in resolution or by compression. The resolution adjustments may be in the form of pixel counts per image, or in frame rate. In other words, if necessary, images may be sent at a faster or slower rate according to available bandwidth. The image resolution may be increased or decreased based on available bandwidth.

Communication bus 128 may take the form of a three wire connection, as mentioned above. For example, the three wire connection may be implemented using standards such as ClimateTalk and BACnet. Communication bus 128 may also take the form of a two, four or eight wire connection, such as CT-485, RS-485, Ethernet 10BASE-T and 100BASE-TX (Ethernet 10BASE-T and 100BASE-TX are technically eight wire interfaces, however, two pairs of the Ethernet interface are not used for 10BASE-T and 100BASE-TX). Communication bus 128 may be adapted to carry a video stream from any of image sensors 172, 176, and 180.

Further, communication bus 128 may be adapted to carry signals which are the result of processing image data sets from image sensors 176 and 180. Indoor controller 124 and outdoor controller 126 may be adapted to offload image processing tasks from system controller 106, in order to reduce bandwidth requirements. For example, indoor controller 124 and outdoor controller 126 may perform recognition tasks, and pass along the results on bus 128, as will be explained below.

Figure 2:
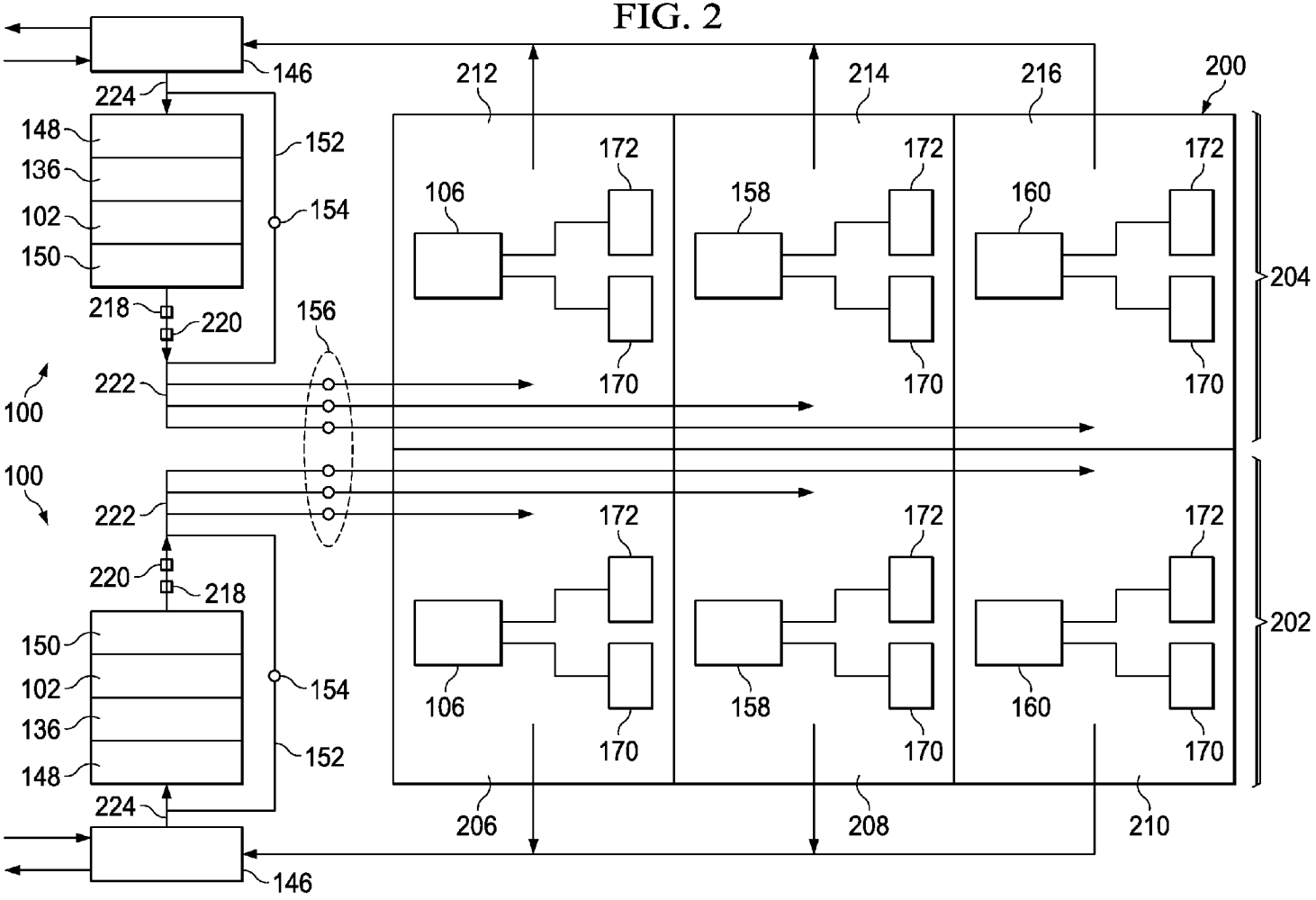
FIG. 2 is a schematic diagram of the air circulation paths of the HVAC system of FIG. 1.

Referring now to FIG. 2, a schematic diagram of the air circulation paths for a structure 200 conditioned by two HVAC systems 100 is shown. In this embodiment, the structure 200 is conceptualized as comprising a lower floor 202 and an upper floor 204. The lower floor 202 comprises zones 206, 208, and 210 while the upper floor 204 comprises zones 212, 214, and 216. The HVAC system 100 associated with the lower floor 202 is configured to circulate and/or condition air of lower zones 206, 208, and 210 while the HVAC system 100 associated with the upper floor 204 is configured to circulate and/or condition air of upper zones 212, 214, and 216.

In addition to the components of HVAC system 100 described above, in this embodiment, each HVAC system 100 further comprises a ventilator 146, a prefilter 148, a humidifier 150, and a bypass duct 152. The ventilator 146 may be operated to selectively exhaust circulating air to the environment and/or introduce environmental air into the circulating air. The prefilter 148 may generally comprise a filter media selected to catch and/or retain relatively large particulate matter prior to air exiting the prefilter 148 and entering the air cleaner 136. The humidifier 150 may be operated to adjust a humidity of the circulating air. The bypass duct 152 may be utilized to regulate air pressures within the ducts that form the circulating air flow paths. In some embodiments, air flow through the bypass duct 152 may be regulated by a bypass damper 154 while air flow delivered to the zones 206, 208, 210, 212, 214, and 216 may be regulated by zone dampers 156.

Still further, each HVAC system 100 may further comprise a zone thermostat 158 and a zone sensor 160. In some embodiments, a zone thermostat 158 may communicate with the system controller 106 and may allow a user to control a temperature, humidity, and/or other environmental setting for the zone in which the zone thermostat 158 is located. Further, the zone thermostat 158 may communicate with the system controller 106 to provide temperature, humidity, and/or other environmental feedback regarding the zone in which the zone thermostat 158 is located. In some embodiments, a zone sensor 160 may communicate with the system controller 106 to provide temperature, humidity, and/or other environmental feedback regarding the zone in which the zone sensor 160 is located.

In some embodiments, the system controller 106 may comprise and/or connect directly with a microphone 170 and/or an image sensor 172. In some embodiments, the zone thermostat 158 may communicate directly with a microphone 170 and/or an image sensor 172. In some embodiments, the zone sensor 160 may communicate directly with a microphone 170 and/or an image sensor 172. In some embodiments, a microphone 170 and/or an image sensor 172 may be attached to a wall mounted air handler or a ceiling mounted air handler. The skilled artisan will appreciate that the microphone 170 and/or the image sensor 172 may be attached to other HVAC components that may have a line of sight to any of the climate conditioned zones 206, 208, 210, 212, 214, and 216.

While HVAC systems 100 are shown as a so-called split system comprising an indoor unit 102 located separately from the outdoor unit 104, alternative embodiments of an HVAC system 100 may comprise a so-called package system in which one or more of the components of the indoor unit 102 and one or more of the components of the outdoor unit 104 are carried together in a common housing or package. The HVAC system 100 is shown as a so-called ducted system where the indoor unit 102 is located remote from the conditioned zones, thereby requiring air ducts to route the circulating air. However, in alternative embodiments, an HVAC system 100 may be configured as a non-ducted system in which the indoor unit 102 and/or multiple indoor units 102 associated with an outdoor unit 104 is located substantially in the space and/or zone to be conditioned by the respective indoor units 102, thereby not requiring air ducts to route the air conditioned by the indoor units 102.

Still referring to FIG. 2, the system controllers 106 may be configured for bidirectional communication with each other and may further be configured so that a user may, using any of the system controllers 106, monitor and/or control any of the HVAC system 100 components regardless of which zones the components may be associated. Further, each system controller 106, each zone thermostat 158, and each zone sensor 160 may comprise a humidity sensor. As such, it will be appreciated that structure 200 is equipped with a plurality of humidity sensors in a plurality of different locations. In some embodiments, a user may effectively select which of the plurality of humidity sensors is used to control operation of one or more of the HVAC systems 100.

Figure 3:
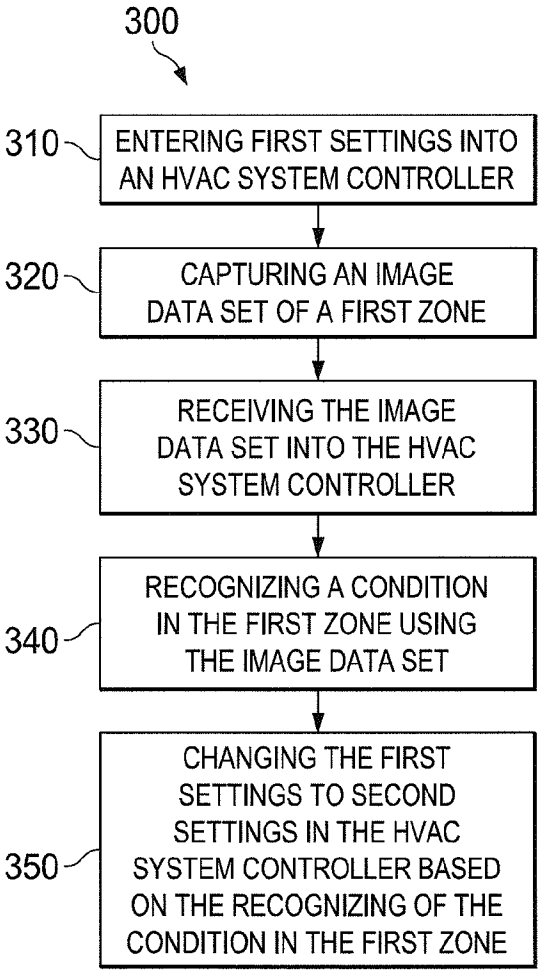
FIG. 3 is a diagram of a method for controlling an HVAC system according to an embodiment of the disclosure.

Referring now to FIG. 3, a flowchart of a method 300 for controlling an HVAC system is illustrated. The method 300 may begin at block 310 by entering first settings into an HVAC controller. An HVAC may utilize settings relating to at least one of a heating temperature setting, a ventilation setting, a cooling temperature setting, a humidity setting, and an air quality setting to operate. The settings may be entered at a factory, distributor, dealership, by an end user, or any other authorized and/or intended person or device. The first settings may be entered as part of a programming process, by either a machine or a human.

The method 300 may continue at block 320 by capturing from an image sensor an image data set of a first zone with an environment at least partially controlled by the HVAC system. In other words, an image sensor produces an image captured from a first zone, for example, one of the zones 206, 208, 210, 212, 214, and 216 described in connection with and illustrated schematically in FIG. 2. The image data set represents a zone with an environment under the control of an HVAC system such as structure 200 in FIG. 2.

The method 300 may continue at block 330 by receiving the image data set into the HVAC system controller at 330. The image data set may be received by any controller in the system such as system controller 106, indoor controller 124 or outdoor controller 126.

Once the image data set is received by an HVAC system controller, the method 300 may continue at block 340 by recognizing a condition in the first zone using the image data set. The condition at 340 may be a selected from among a variety of possible conditions, such as the presence of a particular person or pet. The condition at 340 may be the presence of a plurality of particular people and/or pets. The condition at 340 may be a particular activity of a person, such as mowing grass adjacent an outdoor unit in the HVAC system. The condition at 340 may be the approach of a young child to an outdoor unit with a running fan. Any of the controllers 106, 124, and/or 126 may use known face recognition techniques, image analysis techniques, and pet/human discrimination techniques.

The method 300 may continue at block 350 by changing the first settings to second settings in the HVAC system controller, based on the recognizing of the condition in the first zone. Settings that may be changed may relate to a heating temperature setting, a cooling temperature setting, a humidity setting, a ventilation setting, and an air quality setting. For example, the first setting may be a default heating setting, the condition at 340 may be recognition of a particular individual, and the second setting may be a heating setting for the particular individual. In a more particular example, an adult homeowner may enter a first heating setting to save energy, and a second higher setting which is reserved for when a cold sensitive child or elderly person is in the zone. In another example, an air filtration unit may be turned on when the condition is a recognition of a particular individual who has previously specified air quality settings. The method may also involve resolving priorities, such as when two individuals are in a room with different preferences, the system may prioritize one condition and corresponding setting over another. More particularly, the method may allow for individual A's settings to trump individual B's settings, when both are recognized in the image data set.

A condition recognized at 340 may further relate to pet activities, children playing, adults working, etc. For example, if a small child is recognized in an image data set captured by a camera 180 attached to an outdoor unit 104 (in FIG. 1), the method may comprise temporarily suspending operation of heating or cooling functions in the outdoor unit, to promote safety or reducing the noise generated by the outdoor unit. As another example, if an adult mowing grass is recognized, the outdoor unit may be shut down to avoid sucking debris into the outdoor fan 118 and outdoor heat exchanger 114 in FIG. 1.

Upon recognition of a condition, the method may comprise instituting any HVAC control action, such as increasing or decreasing fan speed on any of the fans 118, 110, operating the indoor EEV controller 138, operating reversing valve 122, operating metering valves 112 and 120, operating ventilator 146, operating zone dampers 156, operating air cleaner 136, operating humidifier 150, and sending signals among controllers 124, 126, and 106, zone thermostat 158, zone sensor 160, and personality modules 134 and 140. Other HVAC control actions will be known to the person skilled in the art.

The method may comprise passing the image data set from an HVAC system controller 106, 124, and/or 126 to a display, and displaying the image data set. This may be done to confirm recognition of the condition, or to set up the condition with the assistance of a user. In other words, the system may require an input image data set to help establish a basis for later recognizing a condition. As part of the input process, the system may need to display the input image for the user, and to receive input. For example, the system may require input of image data sets containing a particular person or a pet, in order to identify the person in a subsequent image data set. The display may be attached to the system as part of a personality module 134 or 140, attached to the communication bus 128, or attached directly to system controller 106. The display may be a part of one of a variety of other devices 130, such as an external computer and monitor system attached by the communication network 132.

Some conditions, such as a person mowing a lawn or a child approaching an outdoor unit, may be complex. In order to recognize a complex condition at 340, the image data set may be a stream or sequence of images. In other words, the image data set may comprise a movie or video, rather than a still photo. Even the recognition of a particular person or pet may require multiple images, for example.

The method may pertain to additional settings which are not historically or traditionally controlled by HVAC systems. For example, an electronic lock may be actuated, or an entertainment device may be powered on or off.

The method may further comprise the reception and processing of audio data from any of the microphones 170, 174, and 178. The audio data may be used in conjunction with the image data set, or separately. For example, voice data could be used in conjunction with image data to recognize an specific individual. Alternatively, voice data could be used by itself to recognize a specific individual. Any of the controllers 106, 124, or 126 may then change an HVAC setting to control at least one of a heating unit, a ventilation unit, a cooling unit, a humidifier, and an air quality control unit based on the audio signals.

Figure 4:
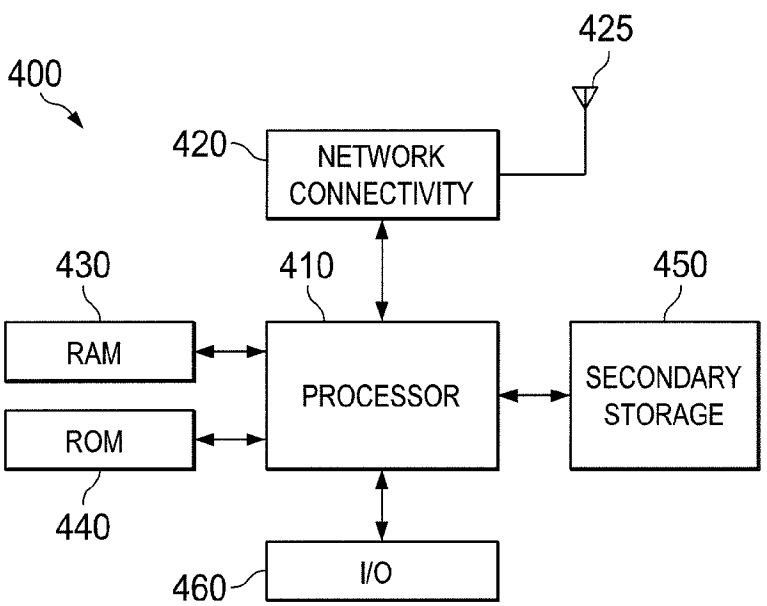
FIG. 4 is a representation of a general-purpose processor (e.g. electronic controller or computer) system suitable for implementing the embodiments of the disclosure.

FIG. 4 illustrates a typical, general-purpose processor (e.g., electronic controller or computer) system 400 that comprises a processing component 410 suitable for implementing one or more embodiments disclosed herein. In addition to the processor 410 (which may be referred to as a central processor unit or CPU), the system 400 might comprise network connectivity devices 420, random access memory (RAM) 430, read only memory (ROM) 440, secondary storage 450, and input/output (I/O) devices 460. In some cases, some of these components may not be present or may be combined in various combinations with one another or with other components not shown. These components might be located in a single physical entity or in more than one physical entity. Any actions described herein as being taken by the processor 410 might be taken by the processor 410 alone or by the processor 410 in conjunction with one or more components shown or not shown in the drawing.

The processor 410 executes instructions, codes, computer programs, or scripts that it might access from the network connectivity devices 420, RAM 430, ROM 440, or secondary storage 450 (which might comprise various disk-based systems such as hard disk, floppy disk, optical disk, or other drive). While only one processor 410 is shown, multiple processors may be present. Thus, while instructions may be discussed as being executed by a processor, the instructions may be executed simultaneously, serially, or otherwise by one or multiple processors. The processor 410 may be implemented as one or more CPU chips.

The network connectivity devices 420 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 420 may enable the processor 410 to communicate with the Internet or one or more telecommunications networks or other networks from which the processor 410 might receive information or to which the processor 410 might output information.

The network connectivity devices 420 might also comprise one or more transceiver components 425 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 425 might comprise separate receiving and transmitting units or a single transceiver. Information transmitted or received by the transceiver 425 may comprise data that has been processed by the processor 410 or instructions that are to be executed by processor 410. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 430 might be used to store volatile data and perhaps to store instructions that are executed by the processor 410. The ROM 440 is a non-volatile memory device that typically has a smaller memory capacity than the memory capacity of the secondary storage 450. ROM 440 might be used to store instructions and perhaps data that are read during execution of the instructions. Access to both RAM 430 and ROM 440 is typically faster than to secondary storage 450. The secondary storage 450 is typically comprised of one or more disk drives or tape drives and might be used for non-volatile storage of data or as an over-flow data storage device if RAM 430 is not large enough to hold all working data. Secondary storage 450 may be used to store programs or instructions that are loaded into RAM 430 when such programs are selected for execution or information is needed.

The I/O devices 460 may comprise liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, the transceiver 425 might be considered to be a component of the I/O devices 460 instead of or in addition to being a component of the network connectivity devices 420. Some or all of the I/O devices 460 may be substantially similar to various components disclosed herein.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and air conditioning (HVAC) system, comprising:

an input device configured to receive at least one of a ventilation setting, a temperature setting, a humidity setting, and an air quality setting;

an image sensor connected to at least one component of the HVAC system, wherein the image sensor is configured to capture image data from a first zone; and a controller connected to the input device and the image sensor, wherein the controller is configured to:

recognize at least one particular occupant;

change at least one of the ventilation setting, the temperature setting, the humidity setting, and the air quality setting to a predefined setting associated with the at least one particular occupant in response to receiving the image data and recognizing the at least one particular occupant, prioritize a first particular occupant over another particular occupant in response to recognizing the at least one particular occupant in the image data, and change the at least one of the ventilation setting, the temperature setting, the humidity setting, and the air quality setting to a predefined associated with the first particular occupant in response to prioritizing the first particular occupant.

2. The HVAC system according to claim 1, further comprising:

an indoor HVAC unit, an outdoor HVAC unit, and a thermostat unit, wherein the image sensor is connected to the controller via at least one of the indoor HVAC unit, the outdoor HVAC unit, and the thermostat unit.

3. The HVAC system according to claim 1, wherein the controller is configured to connect to a network, and wherein the controller is configured to transmit the image data from the image sensor to at least one of a destination on the network, a display attached to the controller, and an HVAC remote control system.

4. The HVAC system according to claim 1, wherein the controller is configured to recognize a predetermined condition from the image data.

5. The HVAC system according to claim 1, wherein the at least one particular occupant comprises at least one of a person in the first zone.

6. The HVAC system according to claim 1, wherein the controller comprises a housing and a display connected to the controller, wherein the display is configured to display the image data set.

7. The HVAC system according to claim 1, wherein the image sensor is at least one of (1) embedded in the at least one component of the HVAC system and (2) carried by the at least one component of the HVAC system.

8. A heating, ventilation, and air conditioning (HVAC) system, comprising:

an input device configured to receive at least one of a ventilation setting, a temperature setting, a humidity setting, and an air quality setting;

a microphone connected to at least one component of the HVAC system, wherein the microphone is configured to capture an audio data from a first zone; and a controller connected to the input device and the microphone, wherein the controller is configured to:

recognize at least one particular occupant, change at least one of the ventilation setting, the temperature setting, the humidity setting, and the air quality setting to a predefined setting associated with the at least one particular occupant in response to receiving the audio data and recognizing the at least one particular occupant, prioritize a first particular occupant over another particular occupant in response to recognizing the at least one particular occupant in the audio data, and change the at least one of the ventilation setting, the temperature setting, the humidity setting, and the air quality setting to a predefined setting associated with the first particular occupant in response to prioritizing the first particular occupant.

9. The HVAC system according to claim 8, further comprising:

an indoor HVAC unit, an outdoor HVAC unit, and a thermostat unit, wherein the microphone is connected to the controller via at least one of the indoor HVAC unit, the outdoor HVAC unit, and the thermostat unit.

10. The HVAC system according to claim 8, wherein the controller is configured to connect to a network, and wherein the controller is configured to transmit the audio data to at least one of a destination on the network, a speaker attached to the controller, and an HVAC remote control system.

11. The HVAC system according to claim 8, wherein the controller is configured to recognize a predetermined condition from the audio data.

12. The HVAC system according to claim 8, wherein the controller is configured to recognize in the audio data at least one of the presence of an animal in the first zone and the presence of a person in the first zone.

13. The HVAC system according to claim 8, wherein the microphone is at least one of (1) embedded in the at least one component of the HVAC system and (2) carried by the at least one component of the HVAC system.

14. A method for controlling a heating, ventilation, and air conditioning (HVAC) system, comprising:

entering a first setting into an HVAC system controller, wherein the first setting is at least one of a first temperature setting, a first ventilation setting, a first humidity setting, and a first air quality setting;

capturing at least one of an image data from an image sensor in a first zone or an audio data from a microphone in a first zone, wherein the first zone is at least partially controlled by the HVAC system;

receiving at least one of the image data or the audio data into the HVAC system controller;

recognizing at least one particular occupant in the first zone as a result of receiving the image data, prioritizing a first particular occupant over another particular occupant in response to recognizing the at least one particular occupant in the image data or the audio data in the first zone, recognizing a condition as a result of receiving the audio data into the HVAC system controller;

changing the first setting to a second setting in the HVAC system controller as a result of recognizing the at least one particular occupant in the first zone and changing the first setting to a third setting as a result of recognizing the condition in the first zone, wherein the second setting is a predefined setting associated with the at least one particular occupant, and wherein the third setting is a predefined setting associated with the condition in the first zone; and changing the first setting to the predefined setting associated with the at least one particular occupant in response to prioritizing the first particular occupant in the first zone.

15. The method of claim 14, further comprising:

passing the image data from the HVAC system controller to a display; and displaying the image data set.

16. The method of claim 14, wherein the image sensor is configured to capture the image data as video.

17. The method of claim 14, further comprising:

passing the audio data from the HVAC system controller to an audio output device; and replaying the audio data.

18. The method of claim 14, wherein recognizing the at least one particular occupant comprises recognizing at least one of a human being and a pet, and wherein recognizing the condition comprises recognizing at least one of the presence of the human being and the presence of the pet.

19. The method of claim 14, wherein recognizing the condition comprises recognizing a specific activity of at least one of a human being and a pet.

20. The method of claim 14, further comprising:

entering a third setting into the HVAC system controller as a result of recognizing the condition in the first zone, wherein the third setting is an electronic lock on at least one of (1) an entry to the first zone and (2) an entertainment device.

* * * * *